US010180295B1

(12) United States Patent
Tang

(10) Patent No.: US 10,180,295 B1
(45) Date of Patent: Jan. 15, 2019

(54) STRUCTURE OF WHEEL TYPE POSITIONING DEVICE

(71) Applicant: Chiao-Wei Tang, Yilan (TW)

(72) Inventor: Chiao-Wei Tang, Yilan (TW)

( * ) Notice: Subject to any disclaimer, the term of this patent is extended or adjusted under 35 U.S.C. 154(b) by 0 days.

(21) Appl. No.: 15/993,872

(22) Filed: May 31, 2018

(51) Int. Cl.
*F41A 9/27* (2006.01)
*F41A 9/74* (2006.01)

(52) U.S. Cl.
CPC . *F41A 9/27* (2013.01); *F41A 9/74* (2013.01)

(58) Field of Classification Search
CPC ..... F41A 9/27; F41A 9/28; F41A 9/26; F41A 9/73; F41A 9/74
See application file for complete search history.

(56) References Cited

U.S. PATENT DOCUMENTS 2,835,171 A * 5/1958 Lyon ..... F41A 9/27 42/59
4,856,410 A * 8/1989 Anderson ..... F41A 3/76 89/161
5,416,999 A * 5/1995 Coury ..... F41A 9/28 42/39.5

* cited by examiner

*Primary Examiner* — Stephen Johnson
(74) *Attorney, Agent, or Firm* — C. G. Mersereau; DeWitt Mackall Crounse & Moore

(57) ABSTRACT

A structure of a wheel-type positioning device includes a gun body, a wheel and a grip portion. A bullet is placed into a receiving slot of the wheel through a lead trajectory on the gun body. The receiving slots of the wheel can sequentially correspond to a barrel to complete loading actions through frontward and rearward reciprocating displacement actions of the grip portion, and through a linking rod of the grip portion driving a limiter thereon to rotate the wheel.

8 Claims, 11 Drawing Sheets

STRUCTURE OF WHEEL TYPE POSITIONING DEVICE

BACKGROUND OF THE INVENTION

(1) Field of the Invention

The invention relates to a structure of a wheel-type positioning device, and more particularly to a wheel-type positioning device capable of achieving rapid and precise loading.

(2) Description of the Prior Art

In the present wheel-type firearms that are frequently seen, multiple bullets are mainly filled into the magazines of the wheel. When the user is operating, the bullets can be sequentially fired, and then new bullets can be filled into the magazines after firing ends. The main feature of the wheel-type firearm is that the wheel rotates by a predetermined angle after one bullet is fired, so that the bullets in other magazines can be sequentially fired. After all the bullets in the magazines are fired, the wheel needs to be pushed out and the new bullets can be filled. It is to be noted that after the wheel is pushed back to the original position, each magazine needs to correspond to the barrel, so that the bullet can be smoothly fired. If a little deviation is present between the magazine and the barrel, the trajectory deviation tends to occur. More seriously, the bore premature may occur. Furthermore, because the wheel needs to be pushed out after the bullets are completely fired, a little deviation and displacement between the magazine and the barrel tend to occur after a long time of use due to the mechanical fatigue of the wheel. This is the frequent drawback criticized by the users.

So, how to improve the above-mentioned drawbacks and problems is the technical difficulties that the inventor of this application wants to solve.

SUMMARY OF THE INVENTION

A main objective of the invention is that the invention is mainly composed of a gun body, a wheel and a grip portion. A bullet is placed into a receiving slot of the wheel through a lead trajectory on the gun body. The receiving slots of the wheel can sequentially correspond to a barrel on the gun body to complete loading actions through frontward and rearward reciprocating displacement actions of the grip portion, and through a linking rod of the grip portion driving a limiter thereon to rotate the wheel.

DETAILED DESCRIPTION OF THE PREFERRED EMBODIMENTS

Figure 1:
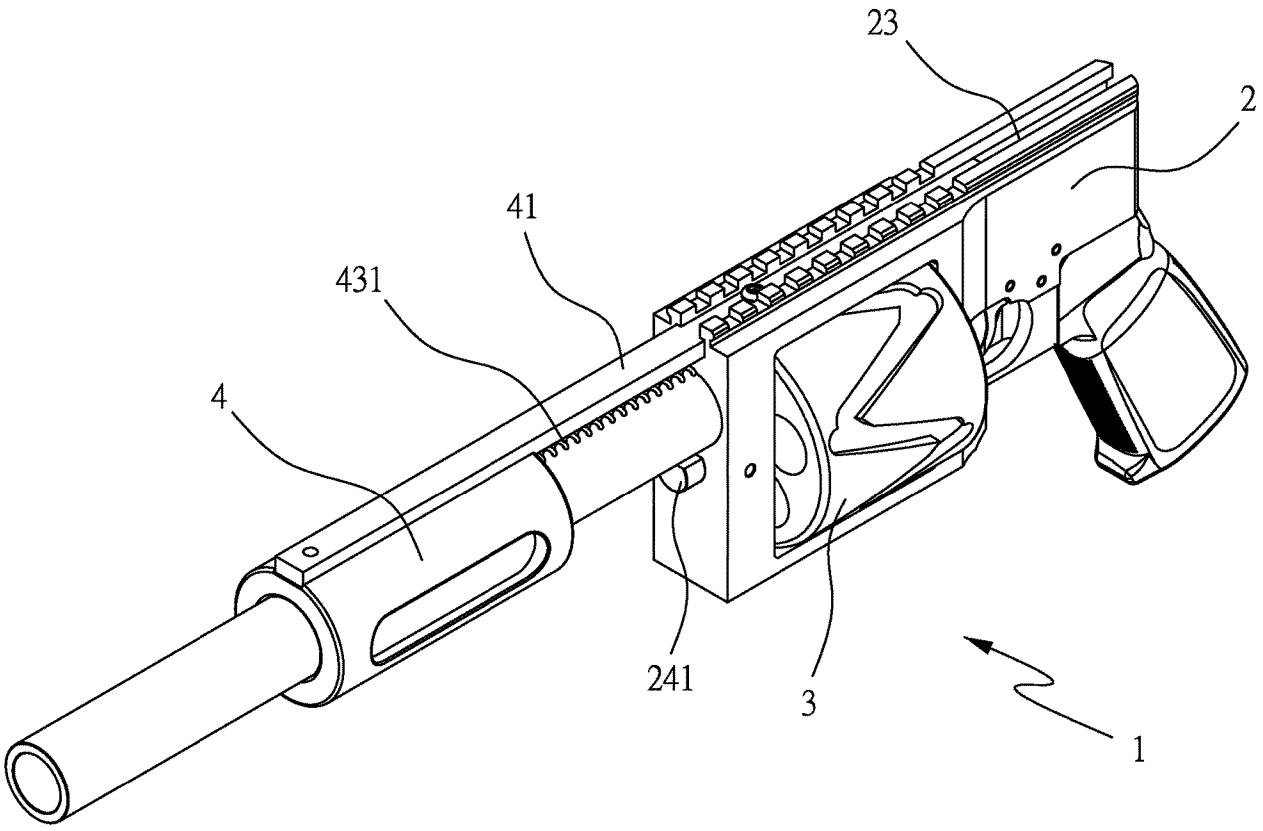
FIG. 1 is a pictorial outlook view showing the invention.
Figure 2:
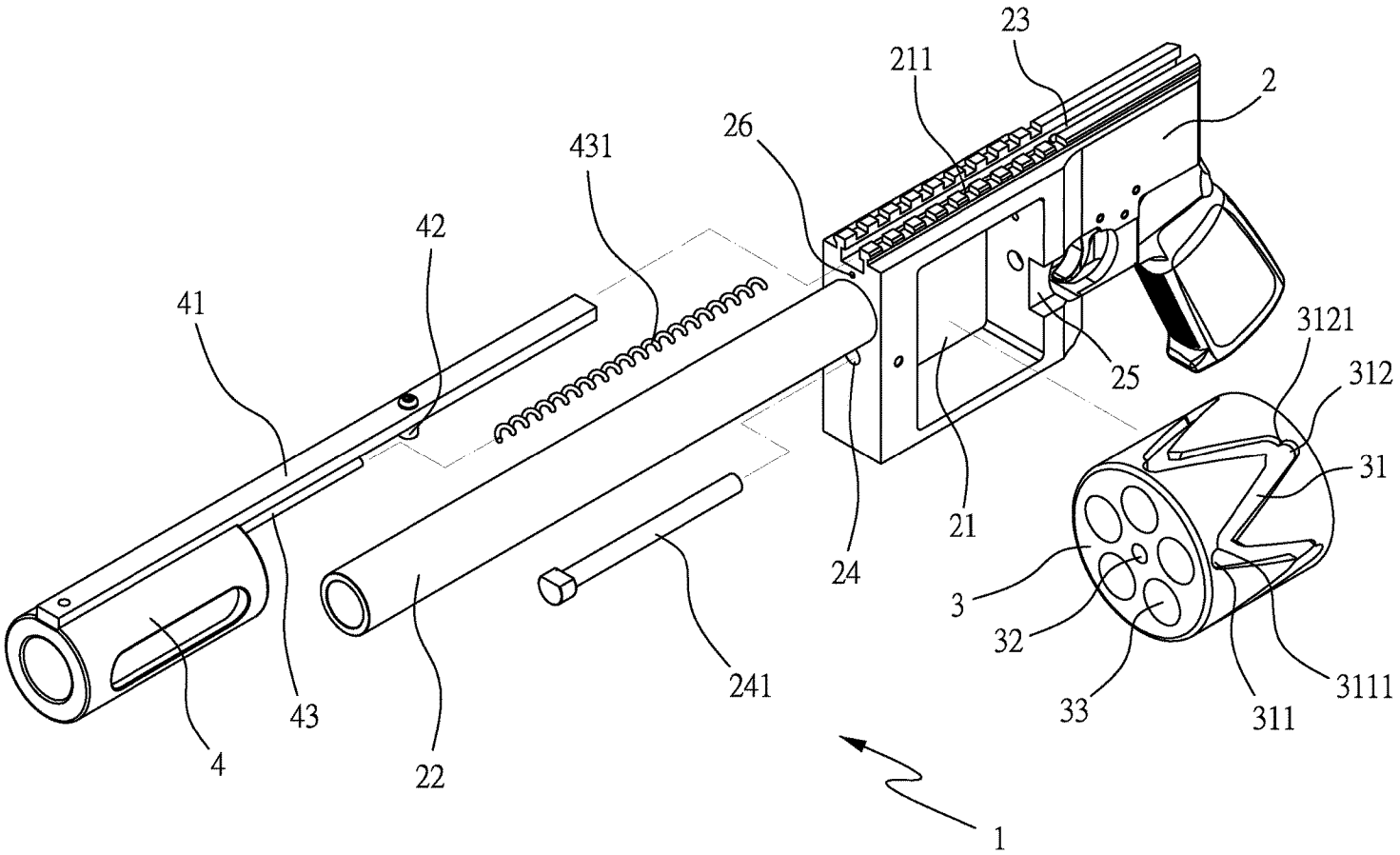
FIG. 2 is a pictorially exploded view showing the invention.
Figure 3:
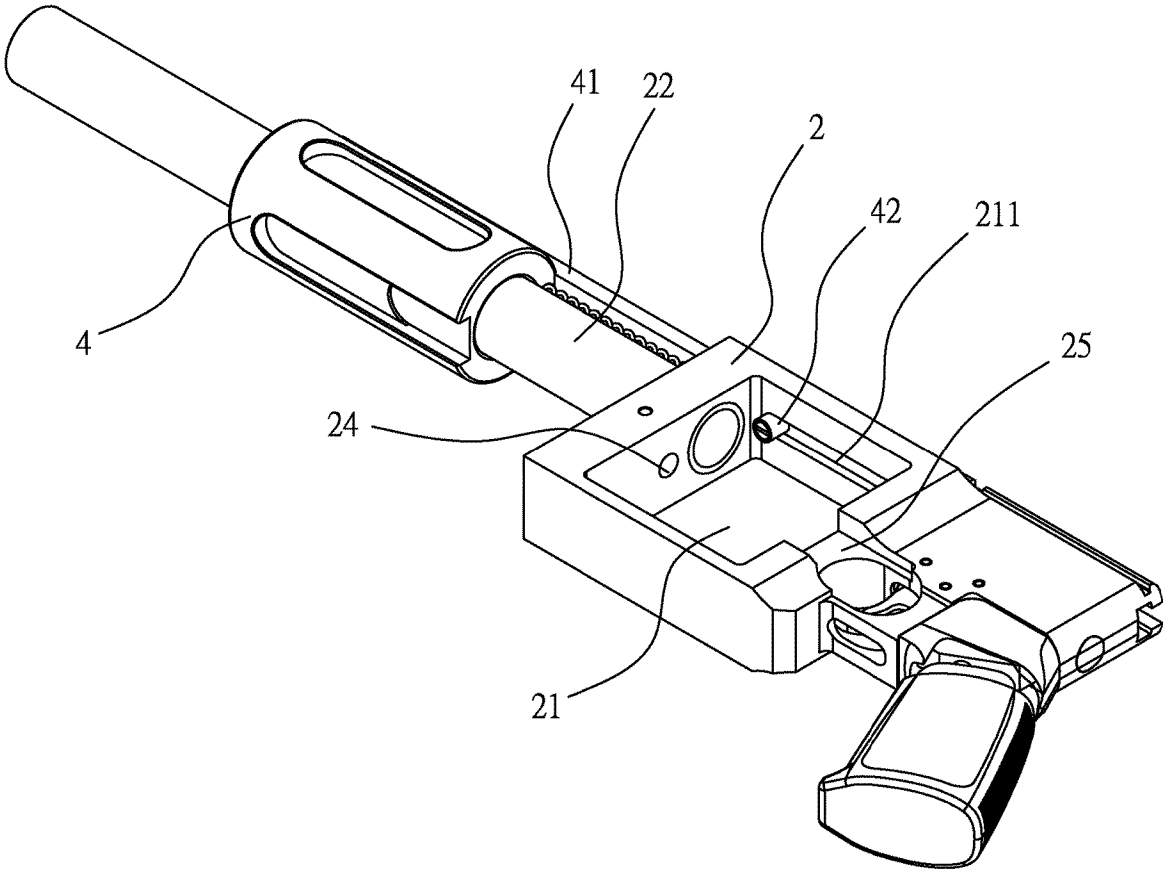
FIG. 3 is a first partial schematic view showing the invention.
Figure 4:
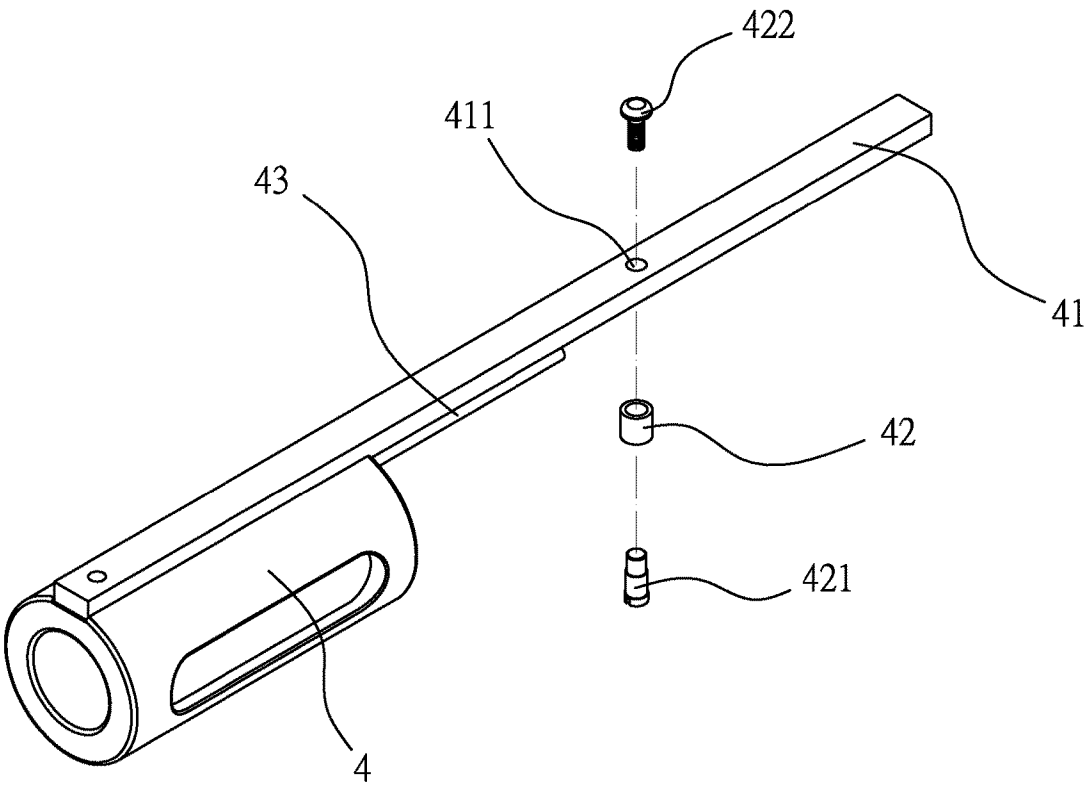
FIG. 4 is a second partial schematic view showing the invention.
Figure 5:
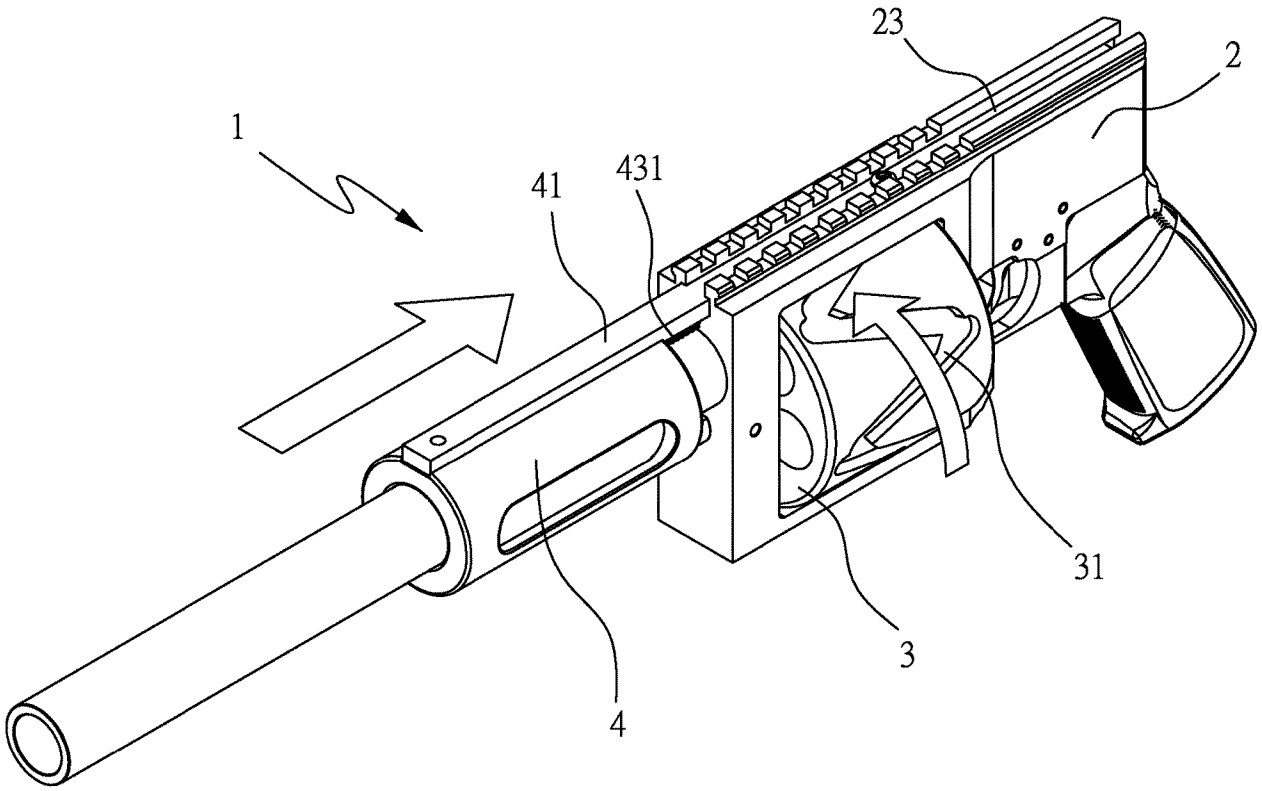
FIG. 5 is a first view showing the preferred embodiment of the invention.
Figure 6:
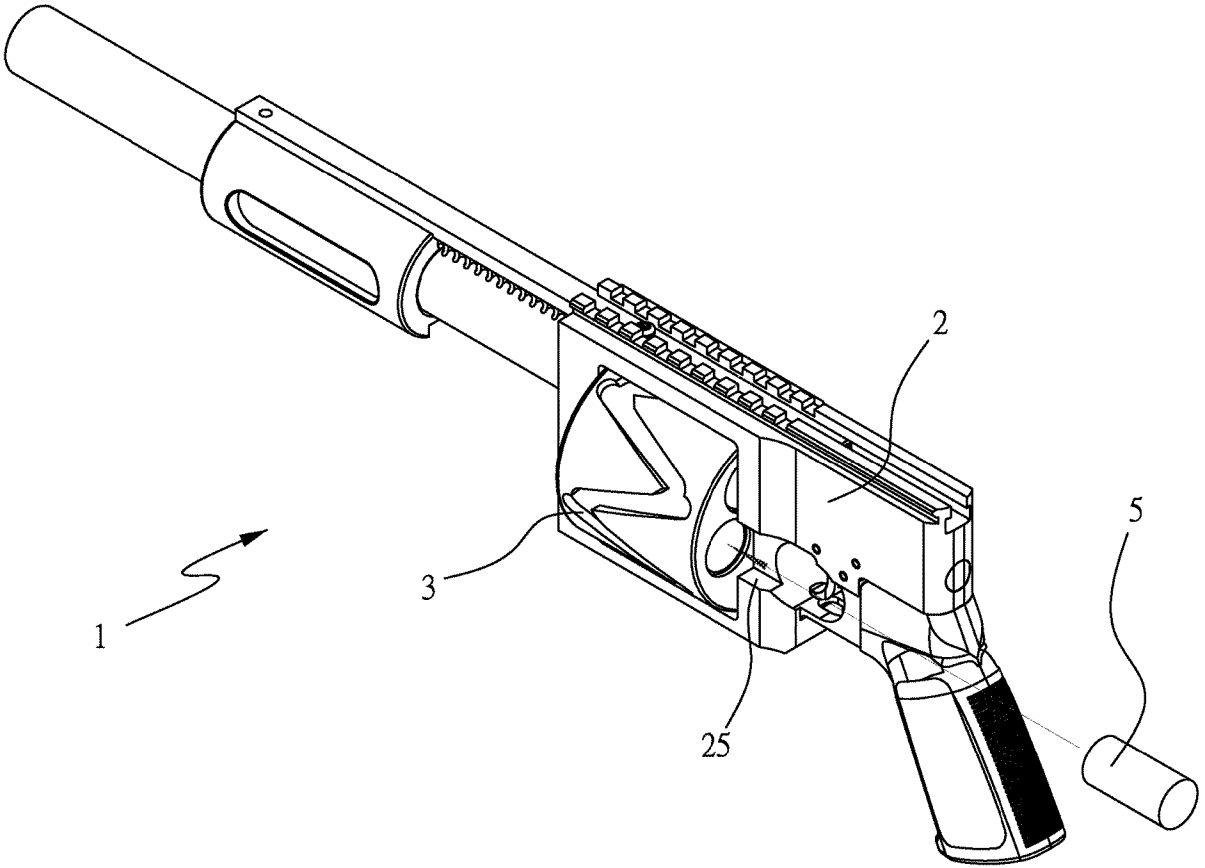
FIG. 6 is a second view showing the preferred embodiment of the invention.
Figure 7:
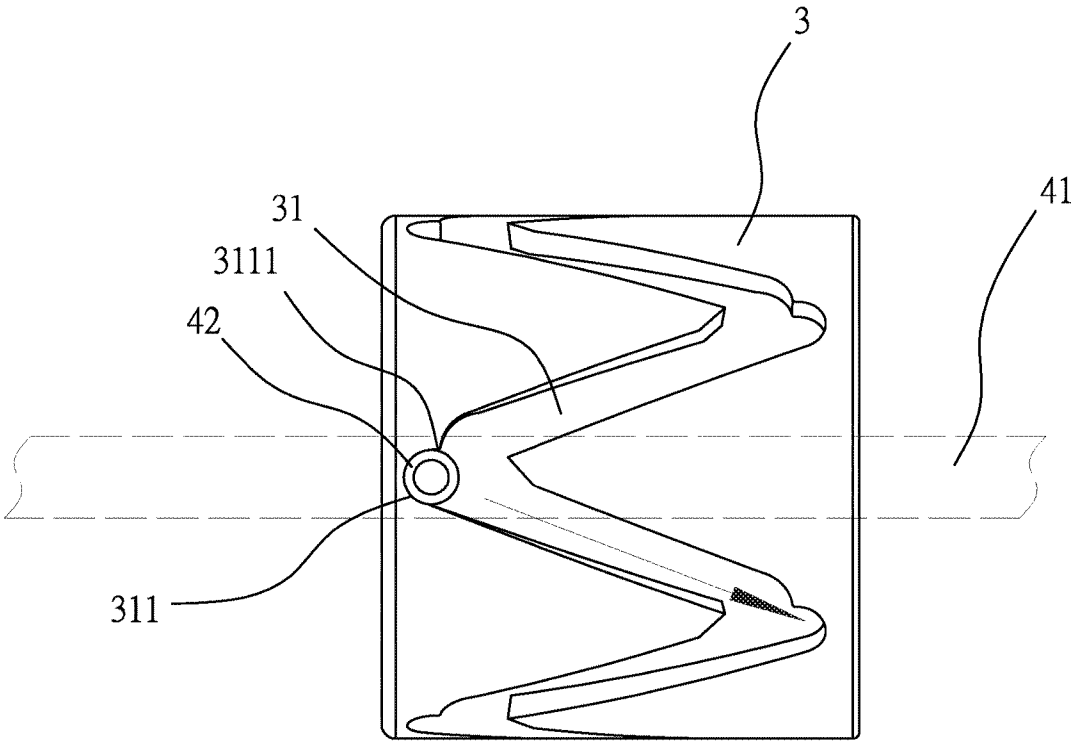
FIG. 7 is a third view showing the preferred embodiment of the invention.
Figure 8:
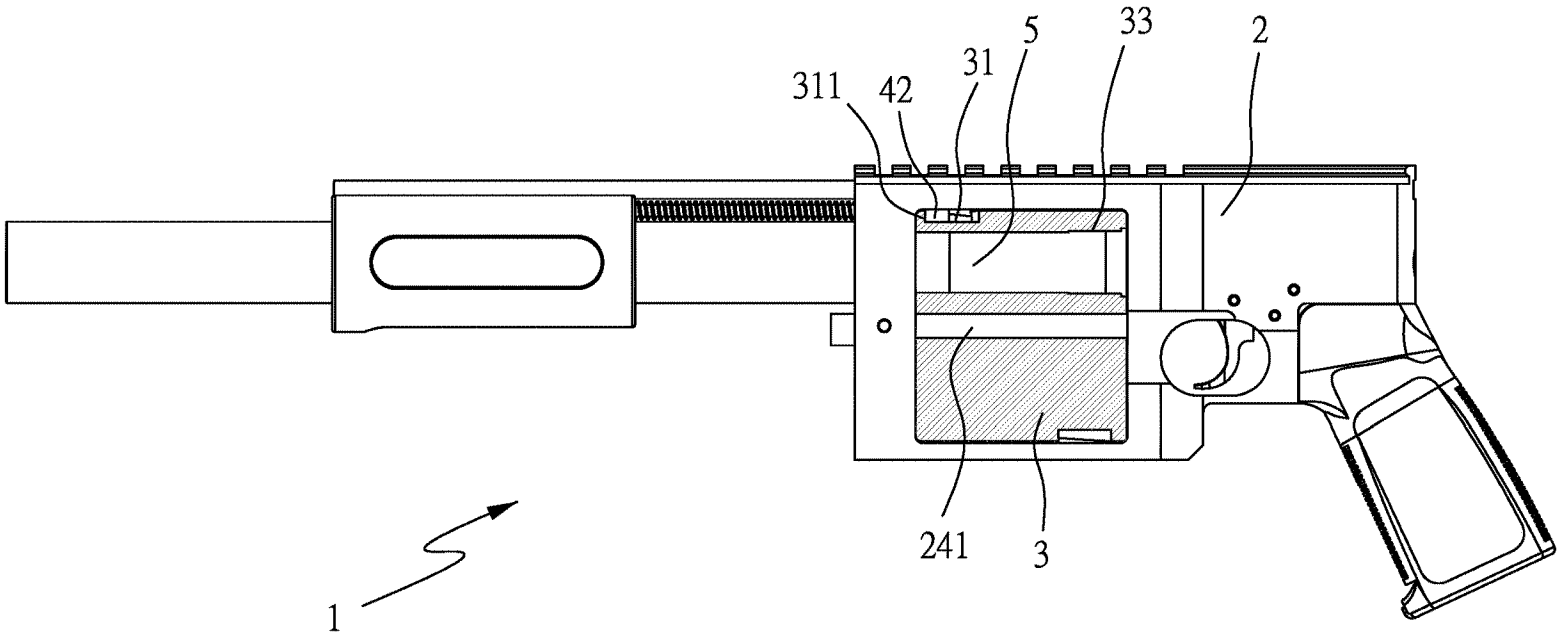
FIG. 8 is a fourth view showing the preferred embodiment of the invention.
Figure 9:
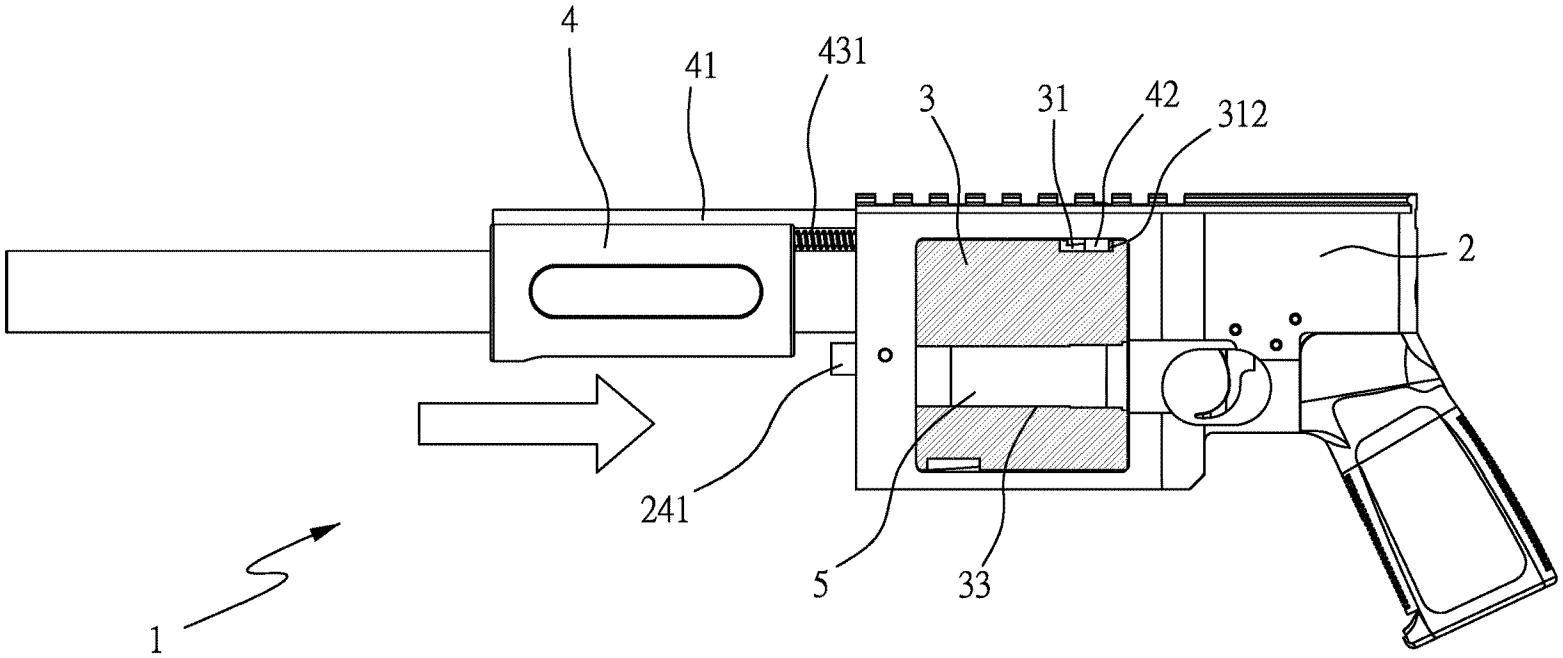
FIG. 9 is a fifth view showing the preferred embodiment of the invention.
Figure 10:
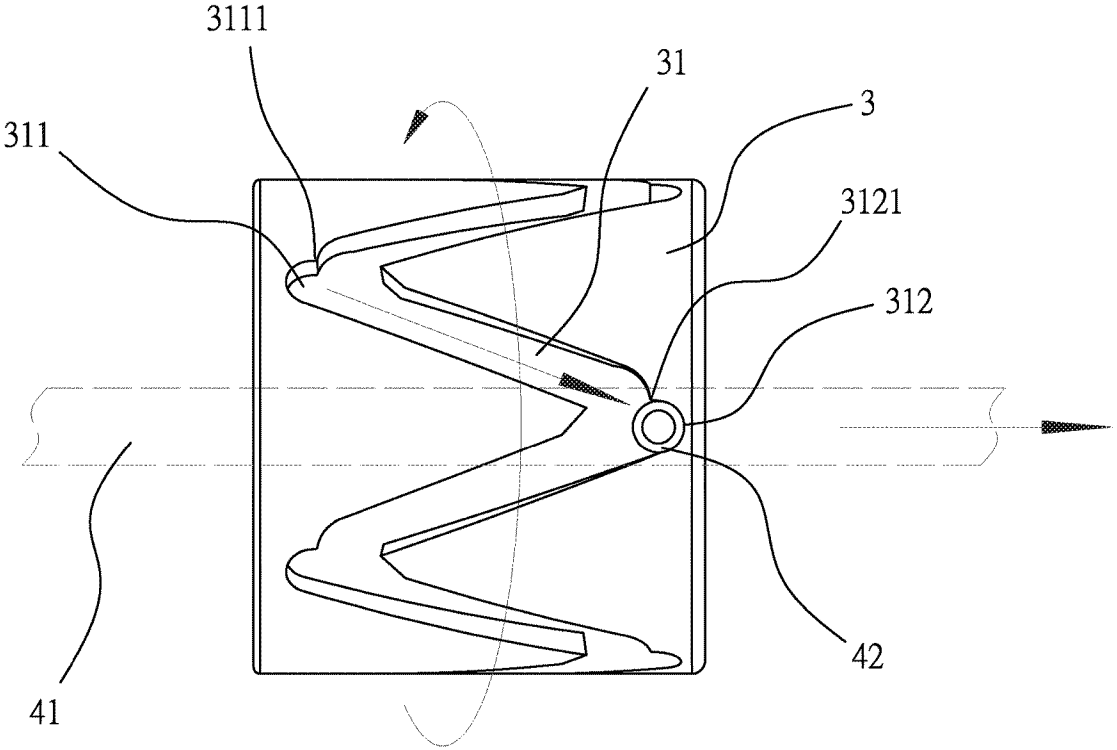
FIG. 10 is a sixth view showing the preferred embodiment of the invention.
Figure 11:
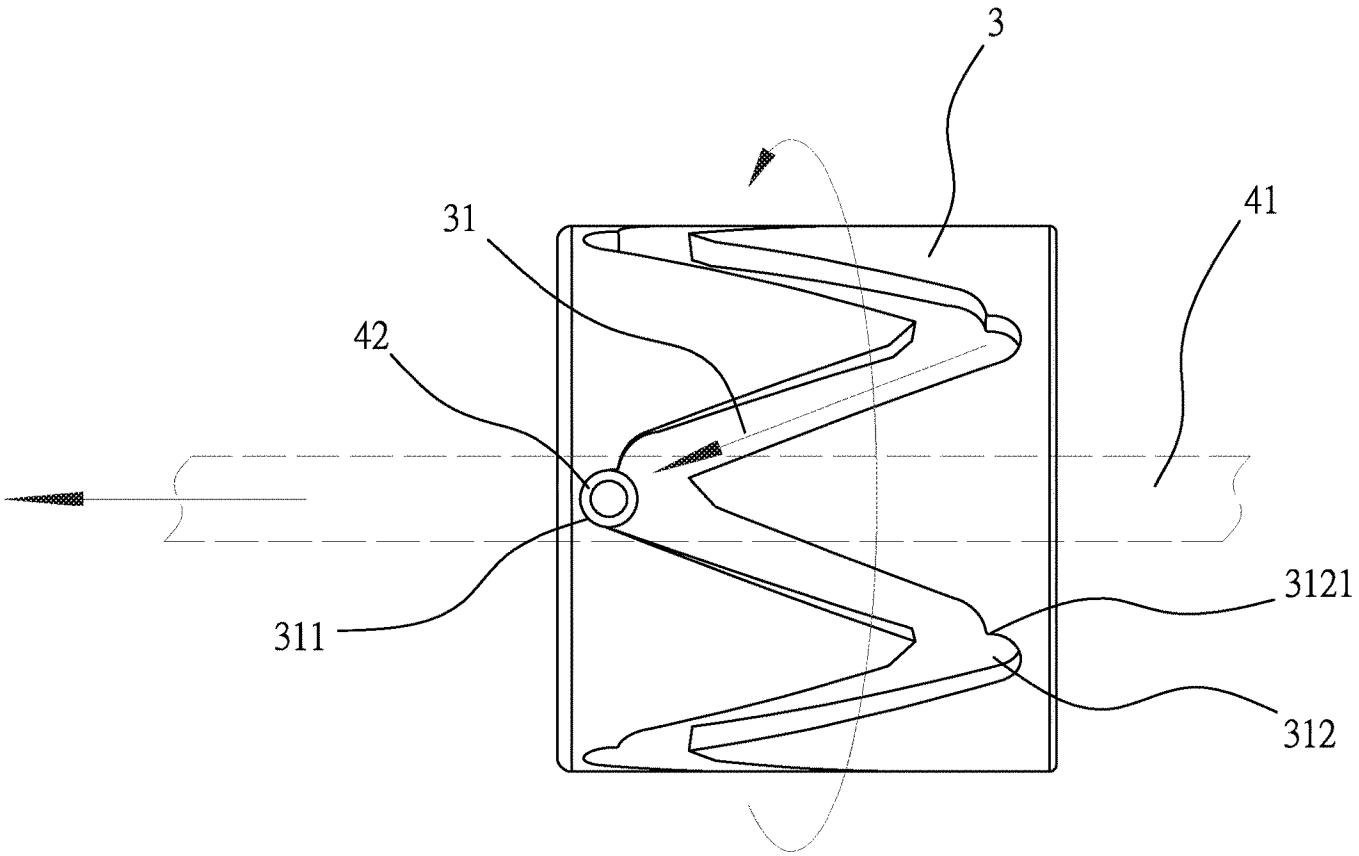
FIG. 11 is a seventh view showing the preferred embodiment of the invention.

FIGS. 1 to 11 are a pictorial outlook view, a pictorially exploded view, and first and second partial schematic views of the invention and first to seventh views of the preferred embodiment. Please refer to FIGS. 1 to 11, it can be clearly seen from the figures that a positioning device 1 of the invention includes a gun body 2, a wheel 3 and a grip portion 4.

The gun body 2 has a hollow slot 21, a groove 211, a barrel 22 and a guide slot 23.

The wheel 3 is disposed in the hollow slot 21 of the gun body 2, wherein a surface of the wheel 3 has a curved guide track 31, and multiple front position-limiting slots 311 and multiple rear position-limiting slots 312 are additionally formed in the curved guide track 31.

The grip portion 4 is fit with the barrel 22 of the gun body 2, and connected with a linking rod 41 and a rod body 43. The linking rod 41 is embedded into the guide slot 23 of the gun body 2, a limiter 42 is additionally disposed on the linking rod 41, the limiter 42 is embedded into the groove 211 of the gun body 2, and the limiter 42 is disposed in the curved guide track 31 of the wheel 3.

One side of the hollow slot 21 is additionally provided with a through hole 24, and a pin 241 passes through the through hole 24.

One side of the hollow slot 21 is additionally provided with a lead trajectory 25, and the other side of the hollow slot 21 opposite to the lead trajectory 25 is provided with a fixing hole 26.

The wheel 3 is additionally provided with an axial hole 32 and multiple receiving slots 33.

A front bump 3111 is disposed in each of the front position-limiting slots 311 of the wheel 3, and a rear bump 3121 is disposed in each of the rear position-limiting slots 312.

The rod body 43 of the grip portion 4 is additionally fit with an elastic member 431.

In addition to the through hole 24, the pin 241 further passes through the axial hole 32 of the wheel 3 at the same time.

One end of the rod body 43 of the grip portion 4 is disposed on the fixing hole 26 of the gun body 2.

The limiter 42 is fixed to a screw hole 411 of the linking rod 41 through a shaft member 421 and a screw member 422, so that the limiter 42 can be rotated.

The positioning device 1 of the invention is mainly characterized in that the user firstly places multiple bullets 5 into the receiving slots 33 of the wheel 3 through the lead trajectory 25, and the receiving slots 33 of the wheel 3 can sequentially correspond to the barrel 22 to complete loading actions through frontward and rearward reciprocating displacement actions of the grip portion 4, and through the linking rod 41 driving the limiter 42 thereon to rotate the wheel 3.

As mentioned hereinabove, after the bullets 5 are placed in the receiving slots 33, the grip portion 4 is firstly pushed back. Because the limiter 42 is located in the curved guide track 31 of the wheel 3 and limited by the curved guide track 31, when the limiter 42 is moved backward, the limiter 42 will drive the wheel 3 to rotate to complete the first action. At this time, the limiter 42 is moved from the front position-limiting slots 311 into the rear position-limiting slots 312 through the curved guide track 31, and the elastic element 431 is in a compressed state. Subsequently, the grip portion 4 is pushed forwards by the reaction force of the compressed elastic element 431. At this time, the limiter 42 leaves the rear position-limiting slots 312 and simultaneously rotates the wheel 3. Finally, the limiter 42 moves into the front position-limiting slots 311 to complete the second action. Through the complete reciprocal strokes of the first and second actions thereof, the multiple receiving slots 33 of the wheel 3 sequentially correspond to the barrel 22 to complete the loading actions.

The grip portion 4 is mainly embedded into the guide slot 23 of the gun body 2 through the linking rod 41, so that the grip portion 4 is guided by the guide slot 23 to complete the frontward and rearward reciprocating displacement actions. The second action of the grip portion 4 (i.e., the action of frontward displacement of the grip portion 4) is completed by the reaction force of the compressed elastic element 431. That is, after the user holds the grip portion 4 to complete the action of rearward displacement, the grip portion 4 is automatically pushed frontwards by the elastic member 431 to complete the whole loading actions.

As mentioned hereinabove, the bullets 5 may be placed into the receiving slots 33 of the wheel 3 through the lead trajectory 25 to complete the loading actions. In addition, after the bullets 5 are fully fired, the bullets 5 after being fired are ejected through the lead trajectory 25, that is, the user sequentially makes the bullets 5 after being fired be ejected from the receiving slots 33 through the lead trajectory 25 by similarly holding the grip portion 4 to complete the action of rearward displacement and to complete the so-called bullet ejecting action.

The curved guide track 31 is equidistantly distributed on the surface of the wheel 3, and the angles of the curved guide track 31 must be equal, so that after the grip portion 4 completes the stroke of the frontward and rearward reciprocating displacement actions every time, the angle of rotation of the wheel 3 is the same every time. Thus, each of the receiving slots 33 of the wheel 3 can sequentially and accurately correspond to the barrel 22.

The main reasons why the front bump 3111 is disposed in each of the front position-limiting slots 311, and why the rear bump 3121 is disposed in each of the rear position-limiting slots 312 will be described in the following. Through resisting and restriction of the front bumps 3111 and the rear bumps 3121, the limiter 42 can sequentially move to a next one of the front position-limiting slots 311 or the rear position-limiting slots 312. That is, provisions of the front bumps 3111 and the rear bumps 3121 can prevent the limiter 42 from moving and returning to a previous position, so that the wheel 3 rotates in the same direction. Furthermore, the limiter 42 is embedded into the groove 211 of the gun body 2, so that the limiter 42 is guided by the groove 211 to complete the frontward and rearward reciprocating displacement actions of the grip portion 4. Meanwhile, by the reaction force of compressing the elastic member 431, the limiter 42 is not forced to move arbitrarily unless the limiter 42 is subjected to the frontward and rearward reciprocating displacement actions of the grip portion 4 through the linking rod 41.

In addition, the main reason why the limiter 42 is fixed to the screw hole 411 of the linking rod 41 by a shaft member 421 and a screw member 422 is that the limiter 42 can be rotated simultaneously when moving in the curved guide track 31 to reduce the friction between the limiter 42 and the curved guide track 31 by the rotation of the limiter 42, so that the limiter 42 moves more smoothly and quickly in the curved guide track 31.

In summary, compared with the various drawbacks of the conventional wheel-type firearms, the positioning device 1 of the present invention is mainly designed to allow the user to adopt the reciprocating displacement actions of the grip portion 4 through the curved guide track 31 provided on the wheel 3 and the limiter 42 of the grip portion 4, so that each of the receiving slots 33 of the wheel 3 can sequentially and accurately correspond to the barrel 22 to easily and quickly complete the actions of loading and positioning.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A structure of a wheel-type positioning device, comprising:

a gun body having a hollow slot, a groove, a barrel and a guide slot, wherein one side of the hollow slot is additionally provided with a lead trajectory;

a wheel disposed in the hollow slot of the gun body, wherein a surface of the wheel has a curved guide track, multiple front position-limiting slots and multiple rear position-limiting slots are additionally formed in the curved guide track, a front bump is disposed in each of the front position-limiting slots of the wheel, a rear bump is disposed in each of the rear position-limiting slots, and the wheel is provided with multiple receiving slots; and a grip portion, which is fit with the barrel of the gun body and connected with a linking rod and a rod body, wherein the linking rod is embedded into the guide slot of the gun body, a limiter is additionally disposed on the linking rod, the limiter is embedded into the groove of the gun body, and the limiter is disposed in the curved guide track of the wheel;

wherein bullets are firstly placed into the receiving slots of the wheel through the lead trajectory on the gun body, and the receiving slots of the wheel can sequentially correspond to the barrel to complete loading actions through frontward and rearward reciprocating displacement actions of the grip portion, and the linking rod of the grip portion drives the limiter thereon to rotate the wheel, wherein the limiter can sequentially move to a next one of the front position-limiting slots or the rear position-limiting slots mainly through resisting and restriction of the front bumps disposed in the front position-limiting slots, and the rear humps disposed in the rear position-limiting slots, wherein provisions of the front humps and the rear bumps can prevent the limiter from moving and returning to a previous position, so that the wheel rotates in a same direction.

2. The structure of the wheel-type positioning device according to claim 1, wherein the one side of the hollow slot is additionally provided with a through hole, and a pin passes through the through hole.

3. The structure of the wheel-type positioning device according to claim 1, wherein the one side of the hollow slot is provided with a fixing hole.

4. The structure of the wheel-type positioning device according to claim 3, wherein one end of the rod body of the grip portion is disposed on the fixing hole of the gun body.

5. The structure of the wheel-type positioning device according to claim 1, wherein the wheel is additionally provided with an axial hole.

6. The structure of the wheel-type positioning device according to claim 5, wherein a pin further passes through the axial hole of the wheel.

7. The structure of the wheel-type positioning device according to claim 1, wherein the rod body of the grip portion is additionally fit with an elastic member.

8. The structure of the wheel-type positioning device according to claim 1, wherein the linking rod is additionally provided with a screw hole, so that the limiter is fixed to the linking rod through a shaft member and a screw member, and the limiter can rotate.

* * * * *